United States Patent [19]

Tuckey

[11] Patent Number: 4,787,343

[45] Date of Patent: Nov. 29, 1988

[54] COMBUSTION ENHANCER FOR INTERNAL COMBUSTION ENGINES

[75] Inventor: Charles H. Tuckey, Cass City, Mich.

[73] Assignee: Walbro Corporation, Cass City, Mich.

[21] Appl. No.: 928,185

[22] Filed: Nov. 7, 1986

[51] Int. Cl.[4] ..... F02B 75/20

[52] U.S. Cl. ..... 123/59 EC; 123/533; 123/59 BM

[58] Field of Search ..... 123/568, 59 BM, 59 EC, 123/533, 575

[56] References Cited

U.S. PATENT DOCUMENTS

| | | | |
|---|---|---|---|
| 2,446,094 | 7/1948 | Mattice | 123/59 EC |
| 3,608,531 | 9/1971 | Baxendale et al. | 123/568 |
| 4,020,801 | 5/1977 | Jarnuszkiewicz | 123/59 EC |
| 4,075,980 | 2/1978 | Anger | 123/59 EC |

FOREIGN PATENT DOCUMENTS

| | | | |
|---|---|---|---|
| 2575523 | 7/1986 | France . | |
| 134714 | 10/1980 | Japan | 123/59 BM |
| 581216 | 6/1944 | United Kingdom | 123/59 BM |

*Primary Examiner*—E. Rollins Cross

*Attorney, Agent, or Firm*—Barnes, Kisselle, Raisch, Choate, Whittemore & Hulbert

[57] ABSTRACT

A fuel system for internal combustion, two-cycle or four-cycle engines in which hot combustion gases are introduced under pressure to the cylinder to be next fired along with raw fuel injection. The purpose is to preheat and atomize the fuel to obtain more efficient and more complete combustion. The respective cylinders are connected by cross-passages whereby hot gases from the combustion in one cylinder will be transferred along with heated vaporized fuel to an adjacent cylinder at proper timing with an electrically triggered fuel injection valve or device.

4 Claims, 3 Drawing Sheets

COMBUSTION ENHANCER FOR INTERNAL COMBUSTION ENGINES

FIELD OF INVENTION

Fuel injection to two-cycle and four-cycle engines with exhaust gas preheat.

BACKGROUND AND OBJECTS OF THE INVENTION

Fuel injection to two-cycle and four-cycle internal combustion engines is a well-known art since the advent of this type of engine. However, there is a constant effort on the part of engineers to increase the efficiency of those engines.

It is an object of the present invention to provide an engine in which the combustion heat of an engine or the heat developed in the engine can be utilized not only to heat the volatile fuel being introduced but to utilize the force of pressures from the engine to assist in the injection and the mixing of the fuel. Another object is the stratification of fuel to increase the efficiency of combustion.

The system to be disclosed can utilize various types of fuel flow control or injection devices. The main object is the use of combustion pressure and heat to atomize finely and vaporize the fuel as well as supply the injection charge pressure and timing. By properly locating a port in one embodiment for the source of combustion pressure, desired timing can be achieved for charge stratification as well as adequate pressure for direct or port injection. In another embodiment, injection timing is controlled by an injection control valve in an electronic timing system.

The system and apparatus to be described can be utilized with most multi-cylinder engines.

Other objects and features of the invention will be apparent in the following description and claims in which the principles of the invention are set forth together with details to enable a person skilled in the art to practice the invention, all in connection with the best mode presently contemplated for the invention.

BRIEF DESCRIPTION OF THE DRAWINGS

Drawings accompany the disclosure and the various views thereof may be briefly described as.

In essence, in the system to be described, fuel is delivered in metered quantities either to a combustion chamber directly or to an intake port of an engine. Hot combustion gases at high pressure are utilized to deliver the fuel from the fuel metering source. Due to the volatility of the fuel, it is partially vaporized by the hot gases and highly atomized due to the high velocities created by the relatively high pressure of the combustion gas source.

DETAILED DESCRIPTION OF THE PRINCIPLES OF THE INVENTION AND THE MANNER AND PROCESS OF USING IT

Figure 1:
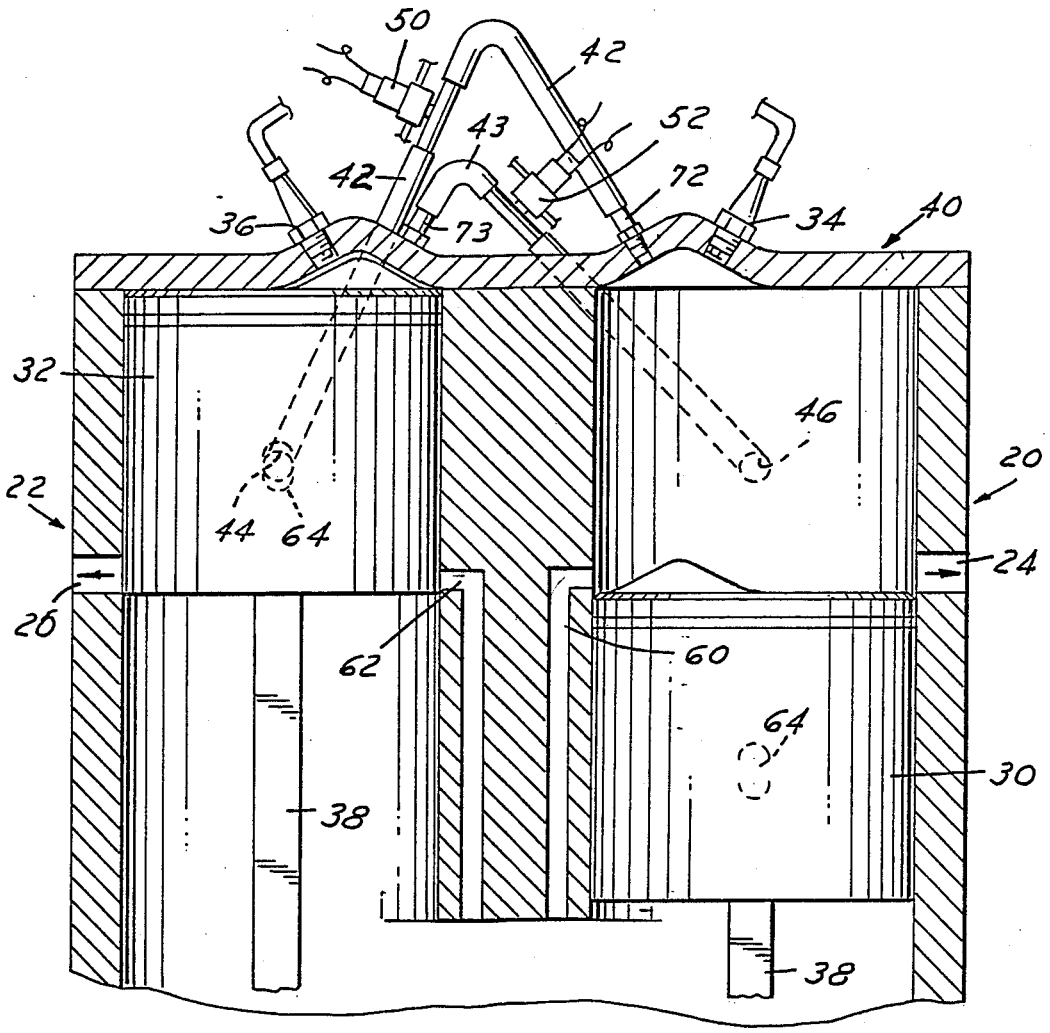
FIG. 1, a diagrammatic view of a two-cylinder, two-cycle engine incorporating the present invention.

In FIG. 1, two cylinders 20, 22 of a two-cycle engine are shown. Each cylinder has an exhaust port 24 and 26 respectively. Cylinder 20 is shown with a piston 30 in a down position with the exhaust port 24 open. Cylinder 22 is shown with a piston 32 in the firing position with the exhaust port 26 closed. Spark plugs 34 and 36 are provided respectively for each cylinder. Each piston will have a connecting rod 38 suitably connected to a crankshaft in a conventional manner.

A cylinder head 40 carries the spark plugs. At cylinder 20 a fuel inlet conduit 42 opens to the combustion chamber, while at cylinder 22 a fuel inlet conduit 43 opens to the combustion chamber. Conduit 42 is connected to a port 44 in the wall of cylinder 22. Conduit 43 is connected to a port 46 in the wall of the cylinder 20.

Figure 2:
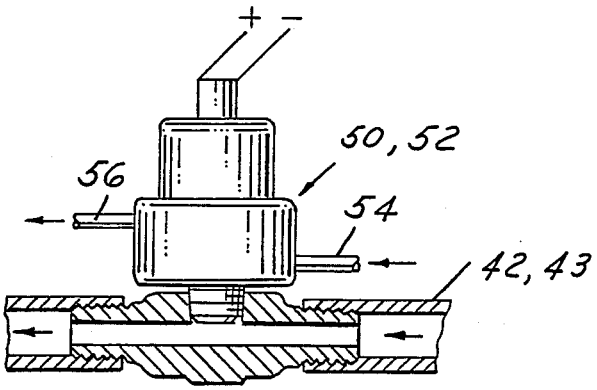
FIG. 2, a view of a fuel injector.

A fuel injector 50 of standard construction discharges into conduit 42 leading to cylinder 20. A fuel injection 52 discharges into conduit 43 leading to cylinder 22. In FIG. 2, a fuel injector body 50, 52 is illustrated having a fuel inlet 54 leading from a fuel pump and a return fuel passage 56. The fuel injector discharges at properly timed intervals into the respective passages 42 and 43. Each cylinder has air transfer ports 60 and 62, respectively, which function as in a standard two-cycle engine for scavenging and air transfer from the crankcase to the combustion cylinder.

Each piston has a wall opening 64 which registers with the ports 44, 46 when the piston is at top dead center to relieve pressure in lines 42 and 43. Each line 42 and 43 has a one-way check valve 72 and 73, respectively, to prevent combustion pressure entering from a cylinder to which it is connected.

In the operation in FIG. 1, as the piston 30 is descending during the power stroke, it has opened the port 46 to allow combustion pressure and hot gases to enter conduit 43 through check valve 73 into the combustion chamber of cylinder 22. At the same time, fuel has been injected by injector 52 and this combination of fuel and hot gases reaches the combustion chamber above piston 32 at the proper time for firing. Thus, the fuel is preheated, atomized, and forced into the cylinder 22.

When piston 30 is in the down position, exhaust gas will have been partially exhausted through port 24 and air will be entering the air inlet port 60 to the space above the piston. After firing in cylinder 22, the same function will take place in cylinder 20.

Figure 3:
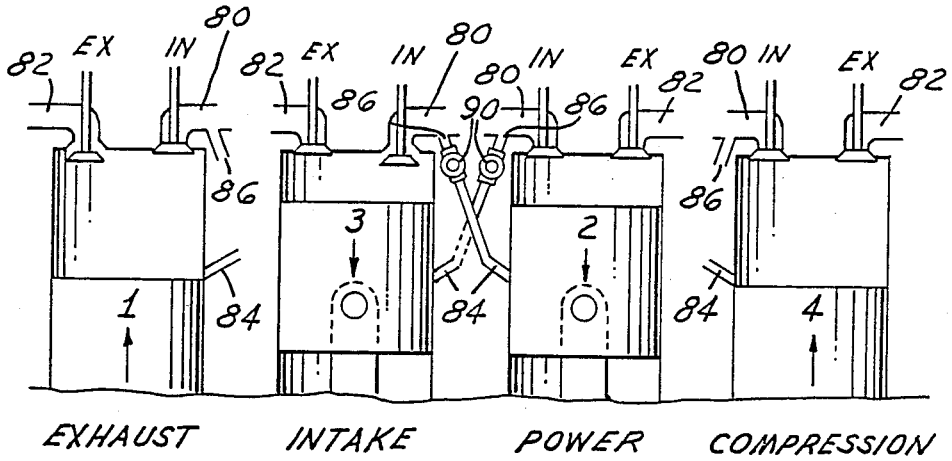
FIG. 3, a view of a four-cylinder, four-cycle engine incorporating the invention.

In FIG. 3, a four-cycle engine is illustrated diagrammatically. Each cylinder has an intake valve and an exhaust valve and each cylinder is connected to another cylinder so that hot combustion gases at high pressure can enter the intake valve area with the fuel charge heated and atomized. Inlet manifold passages are illustrated at 80. Exhaust manifold pressures are illustrated at 82. Cross passages for carrying hot exhaust gases from each cylinder to an associated cylinder are shown at 84. A fuel injector 90 in each passage 84 discharges directly into the passages 84 as previously described in connection with FIG. 1 so that the fuel from the injectors is partially vaporized and highly atomized by the hot combustion gases. The passages leading to the inlet manifold and valves are shown at 86. The passages 84 can discharge directly into the combustion chamber with the use of a one-way check valve at the discharge point.

Figure 4:
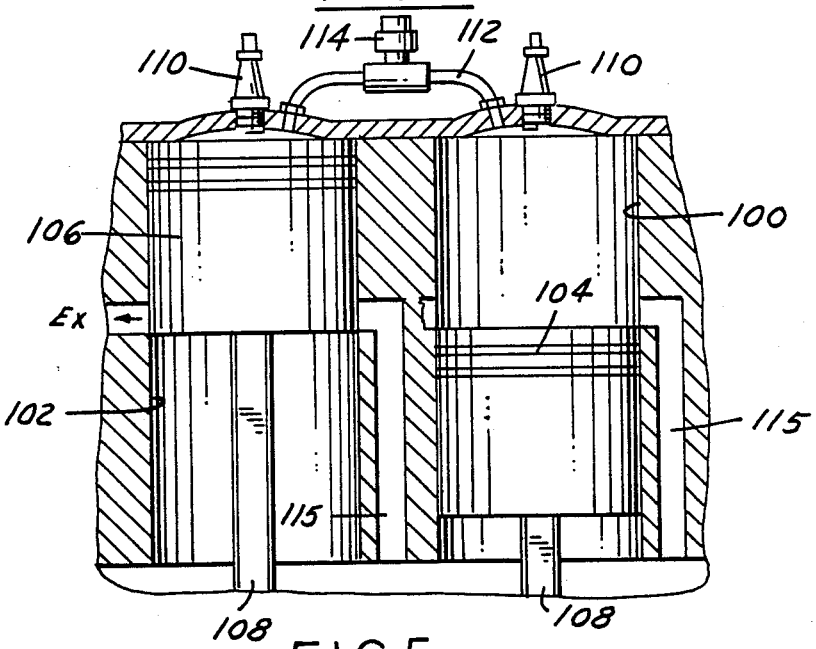
FIG. 4, a view of a modified two-cycle engine with an injector cross-passage.

In FIG. 4, a multiple cylinder, two-cycle engine is again shown with cylinders 100 and 102 and respective pistons 104 and 106. Connecting rods 108 are provided in a conventional way. Spark plugs 110 are provided in each cylinder head. A cross-package 112 is open at each end to a respective cylinder head. Between the cylinders in the cross-package 112 is mounted a fuel injector 114 which is electrically operated in a standard way. Each cylinder has a usual exhaust port in the cylinder wall and an air transfer port 115 opening to the crankcase.

In FIG. 4, the piston 106 is at a top position just ready to start a power stroke. The piston 104 is at bottom dead center just starting on the up stroke. As the piston 104 has approached the lower dead-center position, the passage 112 is open to the cylinder head of the cylinder 102. Hot gases move into the cylinder 100 and at the same time the fuel injector is fired to admit fuel into passage 112 where it is carried by the hot gases into the firing chamber of the cylinder 100. Thus, the rising piston 104 compresses the hot fuel and gases just prior to firing. In the reverse cycle the fuel and hot gases are introduced into the cylinder 102.

Figure 6:
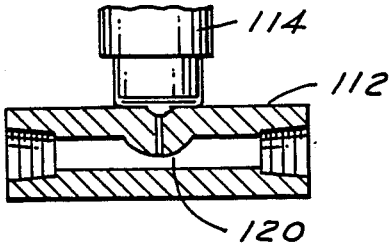
FIG. 6, a sectional view of a fuel injector cross-passage.

FIG. 6 illustrates the cross-passage 112 and the injector wherein a venturi restriction at 120 is shown. Thus, hot gases from one descending piston will be accelerated at the venturi to carry the fuel into the cylinder with the rising piston.

Figure 5:
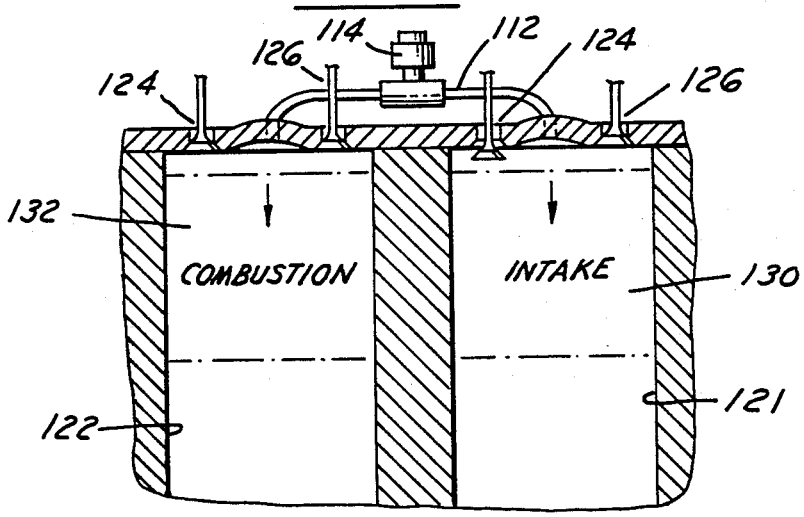
FIG. 5, a second modification showing a four-cycle engine with an injector cross-passage.

In FIG. 5 is a view similar to FIG. 4 in which the cross-over passage 112 extends between four cycle cylinders 121 and 122 each having an intake valve 124 and an exhaust valve 126. In the illustrated view, both pistons 130 and 132 are in the up position. Piston 130 is about to descend in the intake phase and will receive fuel from the injector 114 and a charge of hot gases from the cylinder 122 as well as air from a usual source. The firing sequence will proceed with the forced entry of combustion gases with the fuel in each case.

What I claim is:

1. In a fuel system for a two-cycle internal combustion engine having two or more cylinders with reciprocating pistons having a top stroke position and a bottom stroke position, a fuel inlet at the top of each cylinder, an exhaust outlet in each cylinder positioned to be uncovered by each piston as it reaches the lowest point of its stroke, air transfer ports in each cylinder also uncovered by each piston as it reaches the lowest point of its stroke, a wall port in each cylinder positioned between the top and bottom stroke positions of each piston, a transfer conduit connecting each said wall port of one cylinder with the fuel inlet of a second cylinder, and a fuel injector in each said conduit, whereby in the operation of the engine hot exhaust gases are transferred from one cylinder in which a piston is descending in a power stroke to a second cylinder in which a piston is ascending in a compression stroke, said transferring gases also preheating and atomizing fuel from said fuel injectors.

2. A fuel system as defined in claim 1 in which said wall ports are positioned substantially half-way between said top and bottom stroke positions of said pistons.

3. A fuel system as defined in claim 1 in which a one-way check valve is located in each transfer conduit to pass fuel and hot exhaust gases to the fuel inlet port of a cylinder.

4. A fuel system as defined in claim 1 in which each piston has a wall opening between its ends to register with a wall port in a respective cylinder to selectively relieve pressure in each said transfer conduit as each piston reaches its top position.

* * * * *